US005993362A

United States Patent [19]

Ghobadi

[11] Patent Number: 5,993,362

[45] Date of Patent: Nov. 30, 1999

[54] MARTIAL ARTS CONDITIONING DEVICE

[76] Inventor: Arthur Soroush Ghobadi, 4925 N. 73rd St., #10, Scottsdale, Ariz. 85251

[21] Appl. No.: 09/089,772

[22] Filed: Jun. 3, 1998

[51] Int. Cl.[6] ..... A63B 21/02

[52] U.S. Cl. ..... 482/124; 482/125; 482/121

[58] Field of Search ..... 482/121–130, 482/79; 2/68, 69

[56] References Cited

U.S. PATENT DOCUMENTS

| | | | |
|---|---|---|---|
| 650,656 | 5/1900 | Raabe . | |
| 843,578 | 2/1907 | Muller . | |
| 1,402,179 | 1/1922 | Piscitalli | 482/124 |
| 1,618,273 | 2/1927 | Davidson . | |
| 2,613,932 | 10/1952 | Manners | 482/124 |
| 4,057,246 | 11/1977 | Wilson . | |
| 4,910,802 | 3/1990 | Malloy | 482/124 |
| 5,186,701 | 2/1993 | Wilkinson . | |
| 5,203,754 | 4/1993 | Maclean . | |
| 5,372,565 | 12/1994 | Burdenko . | |
| 5,433,688 | 7/1995 | Davies . | |
| 5,647,827 | 7/1997 | Gutkowski . | |
| 5,716,307 | 2/1998 | Vadher | 482/125 |
| 5,720,042 | 2/1998 | Wilkinson . | |
| 5,752,900 | 5/1998 | Holland | 482/124 |

FOREIGN PATENT DOCUMENTS

| | | |
|---|---|---|
| 30562 | 11/1907 | Switzerland . |
| 150956 | 2/1932 | Switzerland . |

*Primary Examiner*—Jerome W. Donnelly

*Attorney, Agent, or Firm*—Fennemore Craig, P.C.; Sandra L. Etherton

[57] ABSTRACT

An exercise device for martial arts conditioning including a belt having rings, a torso harness a hand stirrup for each hand, a knee band for each knee, and an ankle band for each ankle. The harness includes front and back straps and is attached to the belt in the front and the back. A loop is attached on the harness at each shoulder for receiving an elastic cord. At least two more loops are attached to the back strap to receive elastic cords. Specialized channels in the knee band are adapted to receive elastic cords that are attached to the belt and the ankle. A method of use for practicing punching and blocking motions includes passing an elastic cord through the loops on the back harness strap, grasping each end of the cord with either hand, and repeatedly punching and blocking. A method of use for practicing kicking includes attaching elastic bands to the belt, passing them through the specialized channels on the knee band, attaching the cords at the ankle, and repeatedly kicking. The elastic cords provide resistance to the muscles, thereby improving muscle group coordination, strength, and response time. A specialized glove, sit-up wedge, and hand stirrup for use with the invention are disclosed.

14 Claims, 4 Drawing Sheets

MARTIAL ARTS CONDITIONING DEVICE

MARTIAL ARTS CONDITIONING DEVICE

This invention relates generally to exercise devices and methods for using the same. More particularly, this invention relates to exercise devices and methods for martial arts and other martial arts utilizing resistance training for improving muscle strength and tone; punch, block and kick technique; and response time.

BACKGROUND

Skeletal muscle has an intrinsic monitoring system of sensory receptors in muscle, tendon and joints that form a sensory motor feedback loop system with the central nervous system to control muscle function. Sensory input monitors length, tension, and position to help control the speed, duration and intensity of motor effort through positive and negative feed back loops. It is known in the art of exercise and sport that voluntary muscle contractions and controlled body movements improve upon repetition of a specified motion. Skeletal muscle adapts rapidly to alterations in its loading status. Voluntary muscle contractions can be enhanced by applying resistance to specific muscle groups to load controlled contractions of the targeted skeletal muscles. Resistance training improves muscle strength and tone, coordination, and response time.

It is difficult to load specific muscles used in the martial arts, such as those for punches, blocks, and kicks, because the movements are rapid, used in combination, and are difficult to isolate in weight training. It is desirable to increase the load on these muscles with resistance. It is known in the art to use elastic bands, worn in specific arrangement, to provide resistance to targeted muscle groups. The prior art does not disclose an arrangement effective for martial arts exercises.

The prior art chronicles inventions applying this resistance principle in exercise devices. U.S. Pat. No. 650,656 discloses a harness of shoulder straps and a waist strap. U.S. Pat. No. 843,478 discloses a waist belt with elastic cords running on the right and left sides, between the right and left hands and feet, respectively. Recently issued patents include U.S. Pat. Nos. 5,186,701 and 5,720,042 issued to Wilkinson which describe an aerobic exercise garment. The garment is a body suit with anchors at various locations for attaching elastic cords which provide resistance when stretched by the hand or foot. The body suit covers the entire body and is cumbersome because it constrains body movement. The suit does not have anchors and components to enable a user to target muscles specific to martial arts. In U.S. Pat. No. 5,372,565 Burdenko discloses a buoyant waist belt with rings at various locations for attaching elastic cords. The device is more simple and less cumbersome than Wilkenson's, but it, too, lacks anchors and components to enable a user to target muscles specific to martial arts. In U.S. Pat. No. 5,647,827 Gutkowski discloses another exercise belt with cords running to the hands and ankles. The device does not contemplate anchors and components to enable a user to target muscles specific to martial arts.

Other prior art discloses resistance devices for specific parts of the body. U.S. Pat. No. 5,203,754 issued to Maclean describes a leg harness exercise apparatus in which a single elastic cord forms a loop starting at the ankle, running to the knee, waist, and returning to the ankle. The configuration of the device does not encourage proper alignment for kicks, as the cord is positioned on the outside of the leg only. In U.S. Pat. No. 5,433,688 Davies discloses an exercise waist belt for exercising the arms and upper body. The device has a stretchy band with handgrips that slides through a guide attached at the front of the belt, and does not provide resistance to muscles used in martial arts movements.

The prior art discloses exercise devices using elastic bands to increase resistance, but none is designed to enable a user to target muscles specific to martial arts. The known devices are not suited to martial arts because the placement of the elastic bands, and associated resistance and motion vectors, is not conducive to proper martial arts technique. In particular, none provides resistance or guidance to muscles used for proper punching and blocking technique wherein the elastic cords are guided across the back of the user. Further, none provide resistance or guidance to muscles used for proper kicking wherein the elastic cords are guided along the knee of the user.

Therefore, it is an object of this invention to provide an exercise device with appropriate anchors and components to specifically condition muscles used in the martial arts. In particular, it is an object of this invention to provide an exercise device that provides guidance and resistance to punching and blocking movements of the arms and torso through the use of loops in the back of the harness to guide elastic cables that are passed through loops. It is a further object of this invention to provide an exercise device that provides guidance and resistance to kicking movements through the use of a knee band and properly placed guide loops at the waist and ankle. It is also and object of this invention to provide a method of using the disclosed device to properly train muscles for martial arts punches, blocks, and kicks. The foregoing objects are achieved by this invention as described in detail below and shown in the accompanying drawings.

SUMMARY OF THE INVENTION

This invention is an exercise device and method for martial arts conditioning which enables a user to increase muscle resistance when practicing specific martial arts maneuvers such as punches, blocks, and kicks. Elastic cords are positioned at preferred points to provide resistance to the muscles particular to each maneuver, thereby improving proper technique, muscle group coordination, strength, and response time. Alternative embodiments of the device enable the user to strengthen other muscle groups for specific actions such as throwing a baseball or football, swinging a bat or golf club, or shooting a basketball, for example. The device includes a belt having rings, a torso harness a hand stirrup for each hand, a knee band for each knee, and an ankle band for each ankle. The harness is constructed of front and back straps and is attached to the belt in the front and the back. A loop is attached on the harness at each shoulder for receiving an elastic cord. At least two more loops are attached to the back strap to receive elastic cords. Channels in the knee band are also adapted to receive elastic cords, which are attached to the belt and the ankle. A specialized glove and an abdominal wedge for use with the invention are also disclosed for employing the device other exercises or sports. A method of use for practicing punching and blocking motions includes passing an elastic cord through each of the loops on the back harness strap, grasping each end of the cord with either hand, and repeatedly punching and blocking. A method of use for strengthening the torso includes attaching an elastic cord to one side of the belt, attaching the other end to the opposite shoulder loop, and repeatedly rotating the torso against the resistance of the elastic cord. A method of use for practicing kicking includes attaching two elastic bands to the belt for each leg, passing them through the specialized channels on the knee band, attaching the cords at the ankle at preferred points. Repeatedly kicking against the resistance of the elastic cords improves technique and strengthens kicking muscles.

DETAILED DESCRIPTION

Figure 1:
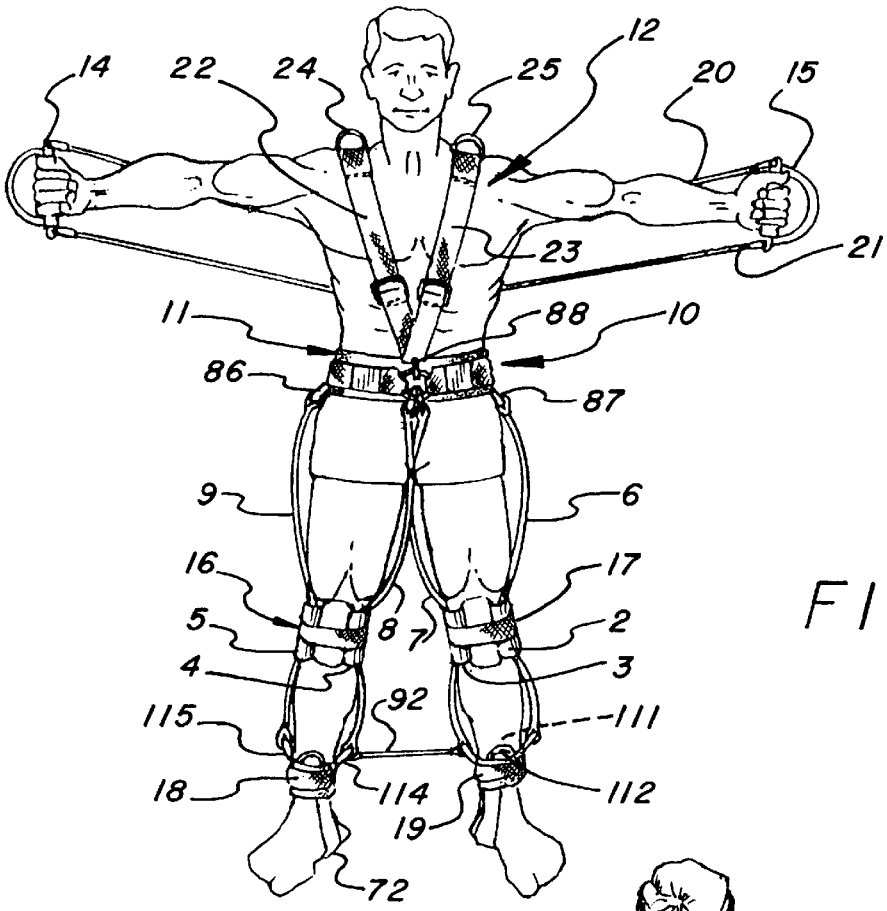
FIG. 1 is a front elevation of a user wearing a preferred embodiment of the invention.
Figure 2:
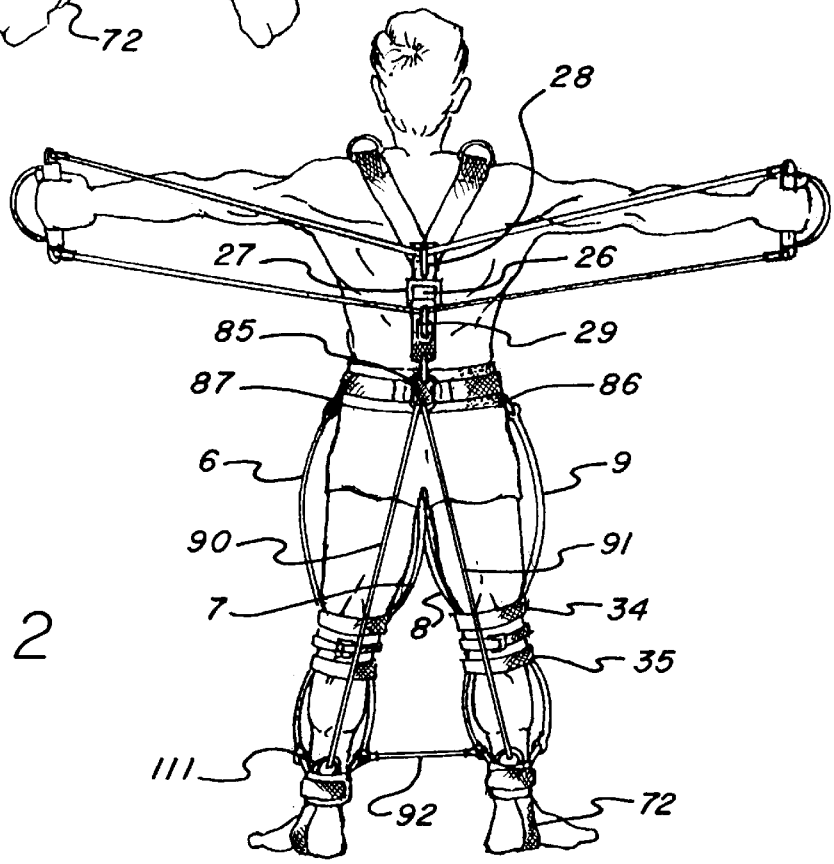
FIG. 2 is a back elevation of a user wearing a preferred embodiment of the invention.

FIG. 1 illustrates the front of a user wearing an exercise device for martial arts conditioning constructed in accordance with a preferred embodiment of the present invention. The exercise device 10 includes belt 11, harness 12, hand stirrups 14 and 15 for each hand, knee bands 16 and 17 for each knee, and ankle stirrups 18 and 19 for each ankle. Elastic cords attach to the device at various locations. FIGS. 1 and 2 show the preferred embodiment in which elastic cords 20 and 21 are connected between the wearer's right and left hands and passed through rings 28 and 29 on the back strap 26. The cords in this arrangement provide increased resistance to the back, shoulder, and arm muscles used in punching and blocking. The dual-cord arrangement enables the user to obtain resistance to the muscles used when twisting the fist in traditional martial art form. FIG. 2 is a view of the back of a user wearing the present invention.

Figure 8:
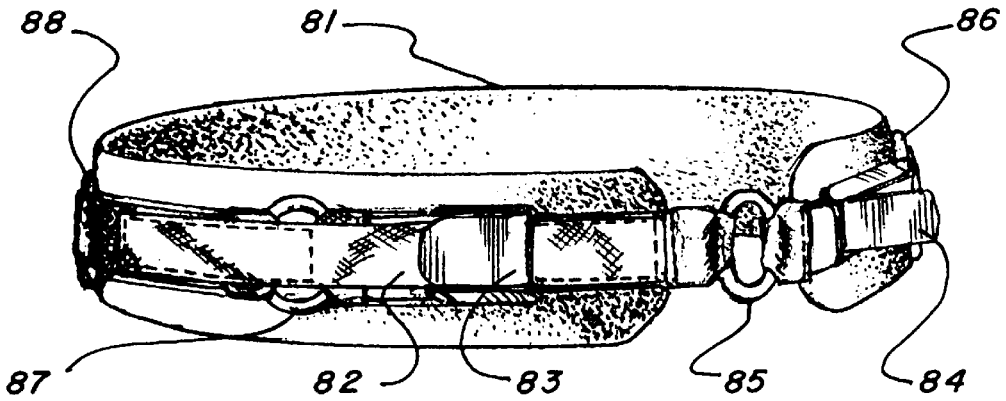
FIG. 8 is a perspective view of the belt of the preferred embodiment of the present invention.

Belt 11 is worn around the waist of the user and secured snugly to provide a strong foundation for the elastic cords which will tug at the belt during exercise. Belt 11 is made of durable materials such as nylon, canvas, or leather. Belt 11 includes two segments that are overlayed and attached securely to each other. FIG. 8 illustrates belt 11 with underlying section 81 having buckle 83 at one end and buckle 84 at the other. Underlying section 81 also has loop-type attachment means such as female half of the product sold under the name Velcro® for mating with overlaying section 82. One end of overlaying section 82 is inserted into buckle 83, and the loose end is further secured to underlying section 81 with hook-type attachment means such as the male half of Velcro®. The other end of overlaying section 82 is inserted into buckle 84, and its loose end is secured to the underlying section 81 with the loop-and-hook type attachment means described above. A protective flap hangs from the center front of the overlaying section 82 to protect the groin area during exercise. Preferably this flap is made of cushioning material such as foam, neoprene, or other padding.

At least four belt rings are attached to belt 11, preferably three belt rings 85, 86, and 87 on underlaying section 81 and one ring 88 on overlaying section 82. The belt rings are positioned around the belt in substantially equal increments, with at least one belt ring 85 at the center back of the belt and one belt ring 88 at the center front of the belt. Due to the overlaying nature of the belt segments, portions of several of the rings may be covered. To enable elastic cords to be attached to the belt, the belt rings must have at least one portion that is not covered. Preferably at least one portion of each belt ring extends beyond the width of the belt, as shown in FIG. 8. Alternatively, two smaller rings may be attached at each of at least four sites around the belt. Each of these rings is attached at only one portion such that the ring rotates freely about its attachment point, giving the attached hook freedom of movement. Ideally, D-rings are used, with the straight portion attached to the belt. The flat portion then acts as a hinge, for the arcuate portion to swing freely.

Harness 12 is worn over the user's torso as shown in FIG. 1. Harness 12 includes right front strap 22 and left front strap 23 forming a "V" and attached at the center front of belt 11. Each strap may have a buckle to adjust the length of the strap. The straps are worn over the user's shoulders, continuing down the user's back. Right shoulder loop 24 is attached to right front strap 22 at a point approximately midway between the ends of the right front strap, such that when worn by the user the shoulder loop is positioned at about the top of the user's shoulder. Similarly, left shoulder loop 25 is attached midway along left front strap 23 and positioned at about the top of the user's shoulder. Front straps 22 and 23 are connected at the ends opposite those attached to the front of the belt to a single back strap 26, as shown in FIG. 2. The back of harness 12 thus looks like a "Y". To adjust the length of harness 12 for various torso lengths, buckle 27 is fitted in back strap 26. Back strap 26 is attached to belt 11 at approximately the center back. At least two pass loops are attached to back strap 26 to guide elastic cords, upper pass loop 28 and lower pass loop 29. More pass loops may be added to accommodate different positions of the cords across the back.

Figure 5:
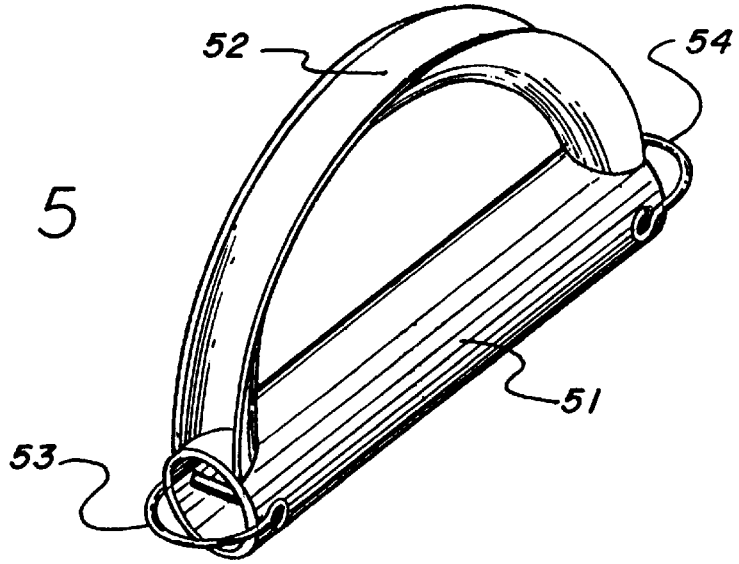
FIG. 5 is a perspective view of a hand stirrup of the preferred embodiment of the invention.

Hand stirrups 14 and 15 are held in the right and left hand, respectively. FIG. 5 shows the hand stirrup in more detail. Each hand stirrup is constructed of handle 51, which is an elongated tubular member having a cross-section to accommodate the palm and fingers of the hand which curl around it. Typically the handle has approximately circular cross-section with depressions for finger placement. Preferably the bar is hollow for lightest weight, but may be solid for increased strength. Each end of handle 51 has ring 53 and 54 for receiving an elastic cord. A curved stirrup 52 extends from the ends of handle 51. Stirrup 52 is concave along its length to accommodate elastic cords as they wrap around handle 51 during the wrist snap of a punch. Preferably handle 51 and the inside of stirrup 52 is padded.

Figure 3:
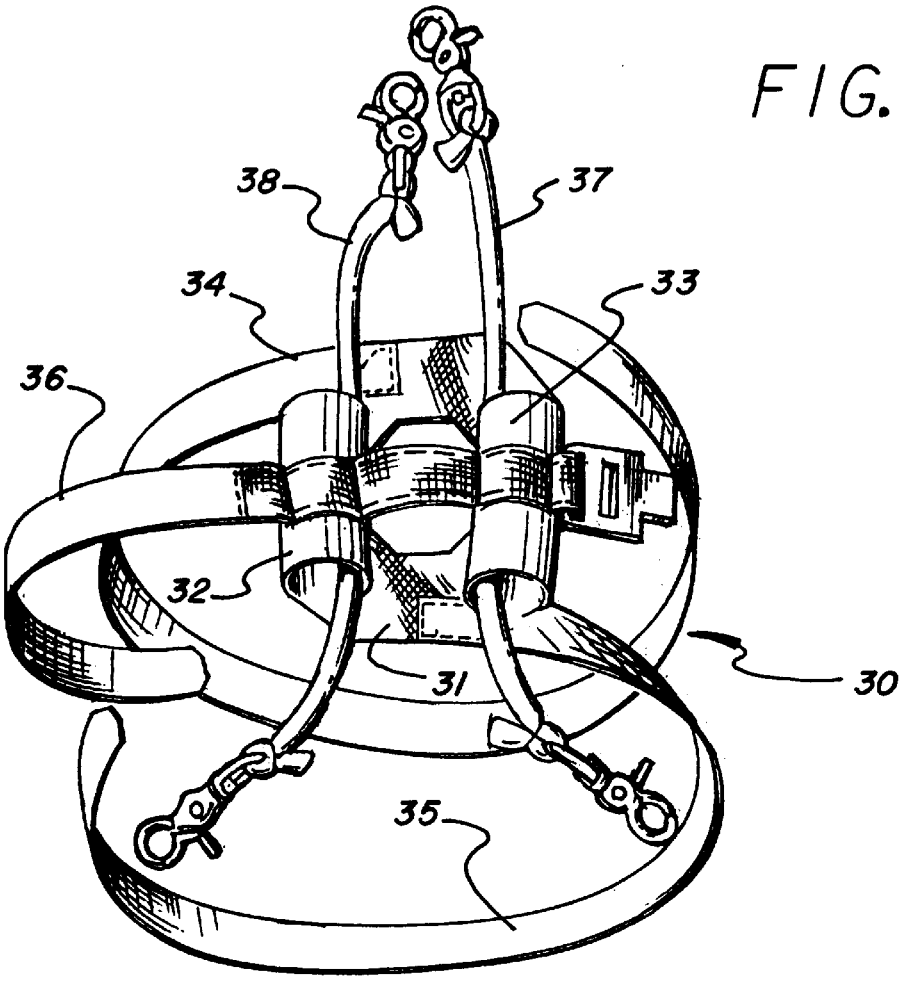
FIG. 3 is a perspective view of a knee band of the preferred embodiment of the invention.

FIG. 3 illustrates the knee band of the present invention which conducts elastic cords in specific directions around each knee. The knee band aligns the cords in proper placement around the knee to provide guidance and resistance to the leg muscles used in kicking. Resistance is provided to both the recoil motion as the leg is prepared to strike, and to the forward motion as the leg is extended to kick. Knee band 30 includes base pad 31 which is worn against the knee. Base pad 31 is shown in an octagonal shape, but any shape that supports the channels and straps is sufficient, such as hexagonal, square, or round. Base pad 31 has a hole near its center to allow the knee cap freedom of motion during exercise. Channels 32 and 33 are attached to base pad 31 and run substantially parallel to the leg along either side of the hole. Each channel is a tube which allows an elastic cord to pass freely, but without too much play. The channels are created in several ways. Preferably the channels are made of nylon webbing which is rolled back onto itself to form a tube, and secured in such shape by Velcro®. Alternatively, the channels may be made as separate components with materials which allow the cords to slide inside the channels. For example, channels of nylon webbing can be made separately and attached to the base pad with stitching, Velcro® or a combination thereof. The channels are positioned to direct proper motion of the knee during kicks.

Knee band 30 is secured to the knee by at least two attachment straps 34 and 35. Preferably strap 34 is near the top of base pad 31 and strap 35 is near the bottom of base pad 31. The ends of the straps are secured with a hook-and-loop type attachment means to avoid interfering with the movement of the elastic cords. To hold the knee band more securely, a third strap 36 is attached between straps 34 and 35 and secured with a buckle or other attachment means. The straps may cross in the back for desired freedom of movement with improved secure attachment.

Figure 7:
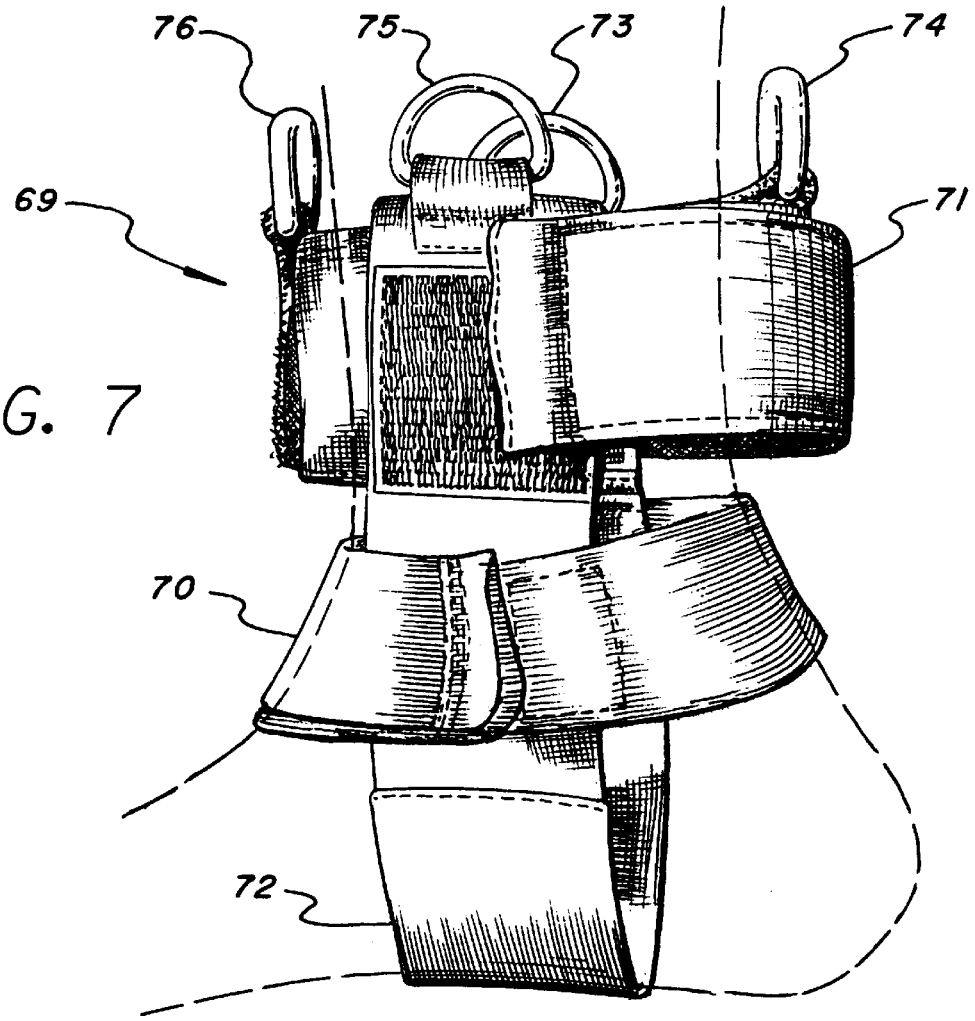
FIG. 7 is a side elevation of an ankle stirrup of the preferred embodiment of the invention.

FIG. 7 illustrates an ankle stirrup 69 of the present invention. Ankle stirrup 69 includes ankle band 70 and ankle strap 71 that encircle the ankle. The ends of ankle band 70 and ankle strap 71 are secured with hook-and-loop type attachment means, such as the product sold under the name Velcro®. Connected to the ankle strap is instep band 72, which encircles the instep. Instep band 72 is connected to ankle strap 71 at points approximately across a diameter of ankle strap 71, such that instep band 72 hangs approximately perpendicular to ankle strap 71. Ankle band 70 is worn over instep band 72, and may be attached to instep band 72 if desired. At least four ankle rings 73, 74, 75, 76 are connected to ankle strap 71 for receiving the elastic bands. The ankle rings are positioned around ankle strap 71 in substantially equal increments, with one ring 73 positioned near the first attachment point of instep band 72 and one ring 75 positioned near the second attachment point of instep band 72.

FIG. 1 and 2 illustrate elastic cords attached to various components of the device in the preferred embodiment. The cords are made of any stretchable material, such as latex, rubber, nylon. Surgical tubing is preferred. Cords may be made of variable resistance by using different materials, using heavier or lighter gauge cord, or lengthening or shortening the cord. Preferably hooks are attached to each end of the cord for attachment to the various rings and loops described herein. Alternatively the cords are attached with other means, such as tying the ends to the rings and loops. The hooks may be covered with soft padding, to prevent injury in the event the hook suddenly detaches from a ring or loop and flails about. Likewise, each cord may be covered in a protective material in the event a cord should break upon over-stretching. For exercising the muscle groups of the arms and torso used in martial arts, one end of elastic punch cord 20 is attached to the thumb-end of the handle of hand stirrup 14 shown in FIGS. 1 and 2. The cord is passed through upper pass ring 28 and attached to the thumb-end of the handle of hand stirrup 15. Similarly, one end of elastic punch cord 21 is attached to the end of the handle of hand stirrup 14 nearest the fifth phalanges (hereinafter referred to as the "pinky"). The cord is passed through lower pass ring 29 and attached to the pinky-end of the handle of hand stirrup 15.

To further isolate muscles used in punching or blocking, in addition to the cords between the hand stirrups, elastic cords are attached in a crossing pattern across the back. For example, one elastic cord is attached at shoulder loop 24 and belt loop 87 and a second elastic cord is attached at shoulder loop 25 and belt loop 86. The cords provide resistance to those muscles used in twisting when a punch or block is given.

For exercising the lower body muscles used in martial arts, four elastic kick cords are attached to the exercise device. Elastic kick cord 6 is attached to belt ring 87, passed through the outside channel 2 of the left knee, and attached to ankle ring 111 on the outside of the user's left ankle. Elastic kick cord 7 is attached to ring 88, passed through the inside channel 3 of the left knee, and attached to ankle ring 112 on the inside of the user's left ankle. Similarly, elastic kick cord 9 is attached to ring 86, passed through the outside channel 5 of the right knee, and attached to ankle ring 115 on the outside of the user's right ankle. Elastic kick cord 8 is attached to ring 88, passed through the inside channel 4 of the right knee, and attached to ankle ring 114 on the inside of the user's right ankle. For additional kicking resistance, three more kick cords are attached. Kick cord 92 is attached between the ankles at inside ankle rings. Kick cord 90 is attached at one end to the belt ring 85 near the center back and to an ankle ring above the left heel. For the other leg, kick cord 91 is attached at one end to the belt ring 85 near the center back and to an ankle ring above the right heel. Additional kick cords are added to isolate other muscle groups.

Figure 4:
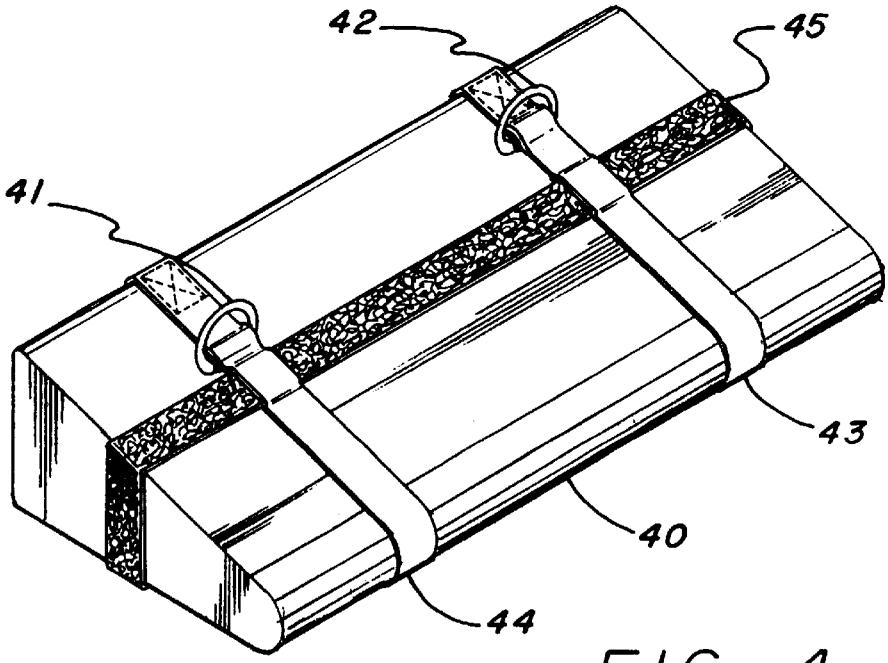
FIG. 4 is a perspective view of an abdominal wedge for use with the invention.
Figure 6:
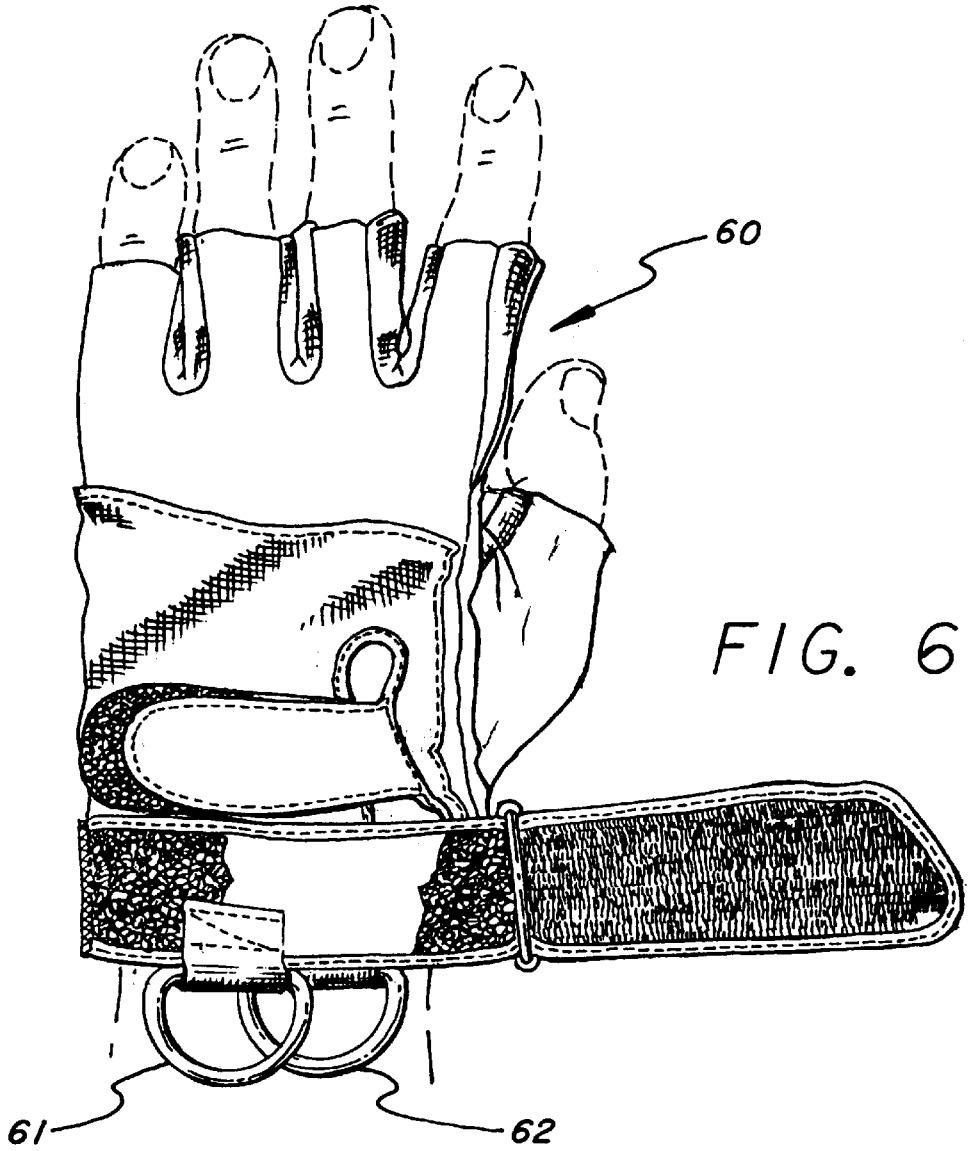
FIG. 6 is a top view of a glove for use with the invention.

Other components can be added to the device to isolate and exercise other muscles. FIG. 4 illustrates abdominal wedge 40 that is used when exercising the abdominal and lower back muscles. Wedge 40 has at least two loops 41 and 42 along its top edge for receiving elastic cords. The wedge is placed under the buttocks of the user as the user lies on the ground to perform sit-ups . Wedge 40 is sturdy enough to support the lower body of the user without compressing. Preferably the wedge is made of plastic and filled with water. Alternatively, the wedge is made of dense foam. FIG. 6 illustrates glove 60 having at least two rings to which elastic cords are attached. Top ring 61 is positioned on the glove at back of the hand and palm ring 62 is on the palm side of the glove. The glove is used in place of the hand stirrup, which would interfere with the use the device, for exercises requiring the hand to grasp an object such as a ball, bat, or golf club.

Repeatedly applying resistance to the desired muscle groups improves muscles strength, technique, and response time. FIG. 1 and 2 illustrate the preferred arrangement of elastic punch cords 20 and 21 for conditioning punching and blocking muscles. After donning the device, the user grasps the hand stirrups and assumes a punching or blocking stance. The punch cord is of such length that when the right arm of the user is recoiled into a position to prepare to punch or block, the cord is unstretched or only slightly stretched. When the right arm is extended in a punch or block, the cord is more fully stretched, thereby offering resistance to the arm muscles during punching or blocking. At the vertex of a punch or block, the wrist is rotated quickly in a "snap" movement. The placement of the elastic cords, namely near the thumb and pinky sides of the fist, provide resistance to this twisting motion, thus enabling the user to strengthen the twist portion of the punch or block. This arrangement of components is also advantageous for practicing all martial arts blocks including low, middle, and high blocks, in the forward or reverse direction.

FIG. 1 and 2 also illustrate the preferred arrangement of elastic punch cords 6–9 for conditioning kicking and jumping muscles. The elastic cords are positioned to offer resistance is the direction of proper kicking motion. In particular, the knee band aligns the cords in proper placement around the knee to provide guidance and resistance in both the recoil and forward motions to the leg muscles used in kicking. This serves to inform the user of the proper kick motion, train the muscles to perform the proper kick motion, and strengthen the muscles for kick motion. This arrangement of components is advantageous for practicing all martial arts kicks including axe, side, spin, and round, and flying kicks, both front and back.

The present invention may also be configured for conditioning muscles used in other sports. For example, to provide resistance to muscles used on throwing a baseball or football, an elastic cord may be attached to top ring 61 of the glove of the throwing hand, passed through the shoulder loop on the side of the throwing hand, and attached to the ankle stirrup at a ring near the heel. For example, on the right ankle the cord would be attached to ankle ring 74. In this manner, resistance is provided an over-hand throwing motion and the associated muscles are strengthened. For pitching a baseball or softball, a pair of elastic cords can be attached to top ring 61 and palm ring 62 of the glove of the throwing hand and to an ankle ring on the outside of the ankle on the same side as the throwing hand. For example, on the right ankle the cord would be attached to ankle ring 73. The arrangement offers resistance to the muscles used in pitching, namely the shoulder, arm, and torso muscles of the side of the pitching arm. Another pair of elastic cords are attached at the center front of the belt, bypassing the knee band, and connected directly to the inside of the ankle. These cords provide resistance to the inner thigh muscle of the lead leg.

Four cords are used for improving batting motion. One cord is attached to the right glove at top ring 61, passed through right shoulder loop 24, and attached directly to the ring at the heel side of the left ankle stirrup. A second cord is also attached to top ring 61 of the right glove, passed through the right shoulder strap, and attached directly to the ring at the side nearest the heel of the right ankle stirrup. The set-up is the same on the left side; A third cord is attached to top ring 61 of the left glove, passed through the left shoulder strap, and attached directly to the ring at the heel side of the right ankle stirrup. A fourth cord is attached to top ring 61 of the left glove, passed through the left shoulder strap, and attached directly to the ring at the heel side of the left ankle stirrup. Two cords are crossed in the back when arranged properly.

Six cords are used for improving a golf swing. One cord is attached to top ring 61 of the right glove and attached directly to the outside ring of the right ankle strap. A second cord is attached to the palm ring 62 of the right glove and attached directly to the inside ring of the right ankle strap. The set-up is the same on the left side; A third cord is attached to the top ring 61 of the left glove and attached directly to the outside ring of the left ankle strap. A fourth cord is attached to the palm ring 62 of the left glove and attached directly to the inside ring of the left ankle strap.

To improve running, the cords are arranged to provide resistance to both the upper body and lower body. The upper body cords are arranged as illustrated in FIGS. 1 and 2. For the lower body, one cord is attached to the belt at the center front ring and directly to the ankle strap at the ring nearest the arch of the foot. A second cord is attached to the center back ring on the belt and attached directly to the ankle strap at the ring nearest the heel. A second pair of cords is arranged similarly for the other leg.

The device may also be used to isolate and provide extra resistance to muscle groups used in calisthenics. For push-ups, the cords are arranged around the upper body as illustrated in FIGS. 1 and 2. For bicep curls, four cords are used. For one arm, a first cord is attached to the thumb-side of the hand stirrup and the other end of the cord is attached to the outside of the ankle strap. A second cord is attached to the pinky-side of the hand stirrup and attached to the inside of the ankle strap. A similar set up is used for the other arm. For shoulder presses and should pull-ups the arrangement is similar, except the hand stirrup is turned around; A first cord is attached to the thumb-side of the hand stirrup and the other end of the cord is attached to the inside of the ankle strap. A second cord is attached to the pinky-side of the hand stirrup and attached to the outside of the ankle strap. A similar set up is used for the other arm. For conditioning the tricep with push-down movements, one end of a cord is attached to the pinky-side of the hand stirrup, the other end passed through the shoulder loops, passed under the arm, and attached to the pink-side of the hand stirrup. A second cord is attached a one end to the thumb-side of the hand-stirrup, passed through the shoulder loop, and attached directly at the other end to the ring nearest the heel of the ankle strap.

Having thus described the invention, it will be apparent to those of skill in the art that various modifications can be made within the scope of the invention. For example, more rings may be attached to the belt and ankle straps to properly position the cords for directing resistance to desired muscle groups.

I claim:

1. An exercise device for martial arts conditioning comprising:

a) a belt configured to be secured around a user's waist having at least three belt rings positioned along the belt at approximately equal intervals;

b) a right knee band configured to be secured around the right knee of the user, the right knee band having a first channel for receiving a kick cord near the outside of the knee and a second channel for receiving a kick cord near the inside of the knee;

c) a left knee band configured to be secured around the left knee of the user, the left knee band having a third channel for receiving a kick cord near the outside of the knee and a fourth knee channel for receiving a kick cord near the inside of the knee;

d) a right ankle stirrup configured to be secured around the right ankle of the user, the right ankle stirrup having at least a first ankle ring near the outside of the ankle and a second ankle ring near the inside of the ankle for attachment to a kick cord;

e) a left ankle stirrup configured to be secured around the left ankle of the user, the left ankle stirrup having at least a first ankle ring near the outside of the ankle and a second ankle ring near the inside of the ankle for attachment to a kick cord;

f) a first elastic kick cord attached at one end to a first right ankle ring, the other end passing slidably through the first channel and attached to a first belt ring;

g) a second elastic kick cord attached at one end to a second right ankle ring, the other end passing slidably through the second knee channel and attached to a second belt ring;

h) a third elastic kick cord attached at one end to a first left ankle ring, the other end passing slidably through the third knee channel and attached to a third belt ring;

i) a fourth elastic kick cord attached at one end to the second left ankle ring, the other end passing slidably through the fourth knee channel and attached to the second belt ring.

2. An exercise device for martial arts conditioning comprising:

a) a belt configured to be secured around a user's waist having at least four belt rings positioned along the belt at approximately equal intervals, a first belt ring positioned near the center back of the user, a second belt ring positioned near the right side of the user, a third belt ring positioned near the center front of the user; a fourth belt ring positioned near the left side of the user;

b) a right knee band configured to be secured around the right knee of the user, the right knee band having a first channel for receiving a kick cord near the outside of the knee and a second channel for receiving a kick cord near the inside of the knee;

c) a left knee band configured to be secured around the left knee of the user, the left knee band having a third channel for receiving a kick cord near the outside of the knee and a fourth knee channel for receiving a kick cord near the inside of the knee;

d) a right ankle stirrup configured to be secured around the right ankle of the user, the right ankle stirrup having at least a first ankle ring near the outside of the ankle, a second ankle ring near the inside of the ankle, and a third ankle ring near the heel side of the ankle for attachment to a kick cord;

e) a left ankle stirrup configured to be secured around the left ankle of the user, the left ankle stirrup having at least a fourth ankle ring near the outside of the ankle and a fifth ankle ring near the inside of the ankle and a sixth ankle ring near the heel side of the ankle for attachment to a kick cord;

f) a first elastic kick cord attached at one end to the first ankle ring, the other end passing slidably through the first channel and attached to the second belt ring;

g) a second elastic kick cord attached at one end to the second ankle ring, the other end passing slidably through the second knee channel and attached to the third belt ring;

h) a third elastic kick cord attached at one end to the fourth ankle ring, the other end passing slidably through the third knee channel and attached to the fourth belt ring;

i) a fourth elastic kick cord attached at one end to the fifth ankle loop, the other end passing slidably through the fourth knee channel and attached to the third belt ring;

j) a fifth elastic kick cord attached at one end to the first belt ring and attached at the other end to the third ankle ring;

k) a sixth elastic kick cord attached at one end to the first belt ring and attached at the other end to the sixth ankle ring;

l) a seventh elastic kick cord attached at one end to the second right ankle ring and attached at the other end to the fifth left ankle ring.

3. An exercise device for martial arts conditioning comprising:

a) a belt configured to be secured around a user's waist having at least four belt rings positioned along the belt at approximately equal intervals, a first belt ring positioned near the center back of the user, a second belt ring positioned near the right side of the user, a third belt ring positioned near the center front of the user; a fourth belt ring positioned near the left side of the user;

b) a harness worn over the user's torso, the harness comprising a right and a left front strap connected to the belt at the third belt ring, and a back strap connected to the belt at the first belt ring, the front straps and back strap connected to each other at a connection point at the back of the harness;

c) a right shoulder loop attached to the right front strap intermediate the front of the belt and the connection point, and a left shoulder loop attached to the left front strap intermediate the front of the belt and the connection point;

d) at least two pass rings attached to the back strap;

e) a first elastic punch cord passing slidably through a first pass ring, and a second elastic punch cord passing slidably through a second pass ring;

f) a right hand stirrup having a handle attached at one end to the first elastic punch cord and attached at the other end to the second elastic punch cord;

g) a left hand stirrup having a handle attached at one end to the first elastic punch cord and attached at the other end to the second elastic punch cord;

h) a right knee band configured to be secured around the right knee of the user, the right knee band having a first channel for receiving a kick cord near the outside of the knee and a second channel for receiving a kick cord near the inside of the knee;

i) a left knee band configured to be secured around the left knee of the user, the left knee band having a third channel near the outside of the knee for receiving a kick cord and a fourth knee channel for receiving a kick cord near the inside of the knee;

j) a right ankle stirrup configured to be secured around the right ankle of the user, the right ankle stirrup having a first ankle ring for attachment to a kick cord attached near the outside of the ankle, a second ankle ring attached near the inside of the ankle for attachment to a kick cord, and a third ankle ring attached near the heel side of the ankle for attachment to a kick cord;

k) a left ankle stirrup configured to be secured around the left ankle of the user, the left ankle stirrup having a fourth ankle ring for attachment to a kick cord attached near the outside of the ankle and a fifth ankle ring attached near the inside of the ankle for attachment to a kick cord, and a sixth ankle ring attached near the heel side of the ankle for attachment to a kick cord;

l) a first elastic kick cord attached at one end to the first ankle ring, the other end passing slidably through the first channel and attached to the second belt ring;

m) a second elastic kick cord attached at one end to the second ankle ring, the other end passing slidably through the second knee channel and attached to the third belt ring;

n) a third elastic kick cord attached at one end to the third ankle ring, the other end passing slidably through the third knee channel and attached to the fourth belt ring;

o) a fourth elastic kick cord attached at one end to the fourth ankle loop, the other end passing slidably through the fourth knee channel and attached to the third belt ring;

p) a fifth elastic kick cord attached at one end to the first belt ring and attached at the other end to the third right ankle ring;

q) a sixth elastic kick cord attached at one end to the first belt ring and attached at the other end to the sixth left ankle ring;

r) a seventh elastic kick cord attached at one end to the second right ankle ring and attached at the other end to the fifth left ankle ring.

4. A right ankle stirrup according to claim 3 further comprising:

a) an ankle strap configured to encircle the ankle;

b) an instep band attached to the ankle strap at points approximately across a diameter of the ankle strap, such that the instep band hangs approximately perpendicular to ankle strap;

c) an ankle band positioned over the instep band and configured to encircle the ankle.

5. A left ankle stirrup according to claim 3 further comprising:

a) an ankle strap configured to encircle the ankle;

b) an instep band attached to the ankle strap at points approximately across a diameter of the ankle strap, such that the instep band hangs approximately perpendicular to ankle strap;

c) an ankle band positioned over the instep band and configured to encircle the ankle.

6. A right hand stirrup according to claim 3 wherein the hand stirrup further comprises a stirrup adapted to receive a punch cord attached between the ends of the handle.

7. A right hand stirrup according to claim 6 wherein the handle is an elongated tubular member of adapted to accommodate the palm and fingers, each end of the handle has a ring for attachment to an elastic cord, and the stirrup is arcuate, concave along its length, and padded.

8. A left hand stirrup according to claim 3 wherein the hand stirrup further comprises a stirrup adapted to receive a punch cord attached between the ends of the handle.

9. A left hand stirrup according to claim 8 wherein the handle is an elongated tubular member of adapted to accommodate the palm and fingers, each end of the handle has a ring for attachment to an elastic cord, and the stirrup is arcuate, concave along its length, and padded.

10. A belt according to claim 3 further comprising:

a) an underlying section having a width and a length, a first end and a second end, and at least three belt rings attached to the section;

b) an overlaying section having a width and a length, a first end and a second end, and at least one belt ring attached to the section;

c) a buckle near the first end of the underlying section for receiving a first end of the overlaying section and a buckle near the second end of the underlying section for receiving a second end of the overlaying section;

d) loop-type attachment means on the underlying section for receiving the first end and second end of the overlaying section;

e) hook-type attachment means on the first and second ends of the overlaying section for mating with the loop type attachment means on the underlying section;

wherein the belt is secured when the first end of the overlaying section is inserted into the first buckle, the end passes through the buckle and mates with the hook type attachment means on the underlying section and the second end of the overlaying section is inserted into the second buckle, the end passes through the buckle and mates with the hook type attachment means on the underlying section.

11. A knee band according to claim 3 further comprising:

a) the first and second knee channels attached to a knee pad having an opening at its center and;

b) at least two attachment straps to secure the knee band to the knee.

12. A method for martial arts conditioning for punching using the device according to claim 3 comprising the steps of:

a) grasping one end of the first elastic punch cord with the user's right hand;

b) grasping one end of the second elastic punch cord with the user's left hand;

the punch cord of such length that when the left arm is recoiled into a position to prepare to punch the cord is substantially unstretched and when the left arm is extended in a punch the cord is stretched, thereby offering resistance to the arm muscles during punching;

c) punching with the right arm and then the left arm; and repeating step (c) to guide and provide resistance to muscles used in proper punching technique.

13. A method for martial arts conditioning for blocking using the device according to claim 3 comprising the steps of:

a) grasping one end of the first elastic punch cord with the user's right hand;

b) grasping one end of the second elastic punch cord with the user's left hand;

the punch cord of such length that when the left arm is recoiled into a position to prepare to punch the cord is substantially unstretched and when the left arm is extended in a punch the cord is stretched, thereby offering resistance to the arm muscles during punching;

c) blocking with the right arm and then the left arm; and repeating step (c) to guide and provide resistance to muscles used in proper punching technique.

14. A method for martial arts conditioning using the device according to claim 3 comprising the step of kicking repeatedly to guide and provide resistance to muscles used in proper punching technique.

* * * * *